United States Patent [19]

Hirai et al.

[11] Patent Number: 4,749,371

[45] Date of Patent: Jun. 7, 1988

[54] CONNECTOR FOR A FLAT CABLE

[75] Inventors: Yuji Hirai, Yokahama; Yoshiharu Yokomizo, Yokohama, both of Japan

[73] Assignee: Honda Tsushin Kogyo Kabushiki Kaisha, Tokyo, Japan

[21] Appl. No.: 927,154

[22] Filed: Nov. 5, 1986

[30] Foreign Application Priority Data

Nov. 5, 1985 [JP] Japan ..... 60-169155[U]

[51] Int. Cl.[4] ..... H01R 9/07; H01R 23/66

[52] U.S. Cl. ..... 439/497; 439/402

[58] Field of Search ..... 439/402, 493, 492, 494–497

[56] References Cited

U.S. PATENT DOCUMENTS 4,181,384 1/1980 Dola et al. ..... 439/497

4,260,209 4/1981 Zell et al. ..... 439/497 X

*Primary Examiner*—Eugene F. Desmond

*Attorney, Agent, or Firm*—Birch, Stewart, Kolasch & Birch

[57] ABSTRACT

A connector for a flat cable having a contact housing with a plurality of signal contact members and a plurality of ground contact members being disposed alternately and in parallel one with another. The plurality of contact members being housed within the contact housing and with respective leading portions of the contact members projecting into an internal space formed at a rear portion thereof. A cable base containing a flat cable including a plurality of signal conductors and a plurality of ground conductors disposed alternately and in parallel one with another within the cable base, respective exposed end portions of the conductors are positioned within the cable base on at least one of an upper and lower surface of the cable base. A bus bar is provided in the cable base and being in contact with the end portions of the ground conductors. Wherein inserting the cable base into the internal space of the contact housing a leading portion of each of the signal contact members may be brought into pressure contact with the end portion of the corresponding signal conductors and a leading portion of each of the ground contact members may be brought into contact with a portion of the naked end portion of the corresponding ground conductors being in contact with the bus bar.

14 Claims, 11 Drawing Sheets

CONNECTOR FOR A FLAT CABLE

BACKGROUND OF THE INVENTION

1. Field of the Invention

This invention relates to a connector for a flat cable used for electronic equipment such as a computer.

2. Description of Background Art

There has been hitherto known a connector such as shown in FIG. 24. A connector main body X is provided with signal contact members a, ground contact members b, and a bus bar c connected to the ground contact members b.

A flat cable Y includes plural signal conductors d and plural ground conductors e which are disposed on a single common plane for connection to the connector X. It is customary that the signal conductors d are soldered or spot-welded to the corresponding signal contact members a. In addition, the ground conductors e are soldered or spot-welded to the bus bar c. Further, additionally spaced signal conductors d at a proper interval among the plural signal conductors d are soldered or spot-welded to the corresponding ground contact members b in order to be used for ground conductors e'.

The connecting of the conventional connector to the flat cable is carried out by means of soldering or spot-welding. This type of connection is inconvenient in that the connecting operation becomes troublesome and requires a great deal of time.

SUMMARY AND OBJECTS OF THE INVENTION

This invention has for its object to provide a connector which is free from the inconvenience of prior connectors, and simple in connection with a flat cable.

The present invention is characterized in that a contact housing having plural signal contact members and plural ground contact members are disposed alternately and in parallel one with another within the housing. Respective leading portions of the contact members are projected into an internal space formed at a rear portion thereof. A cable base is provided for connection to a flat cable comprising plural signal conductors and plural ground conductors which are disposed alternately and in parallel one with another. Respective naked end portions of the conductors are mounted at least along one of an upper and lower surface thereof and a bus bar is connected to the naked end portions of the ground conductors. By inserting the cable base into the internal space of the contact housing, a leading portion of each of the signal contact members may be brought into pressure contact with the end portion of the corresponding one of the signal conductors, and a leading portion of each of the ground contact members may be brought into contact with a part of the end portion of the corresponding one of the ground conductors that is in contact with the bus bar.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

FIGS. 1–9 illustrate one example of the present invention. A female connector B for a flat cable is shown disconnected from a male connector A.

Figure 2:
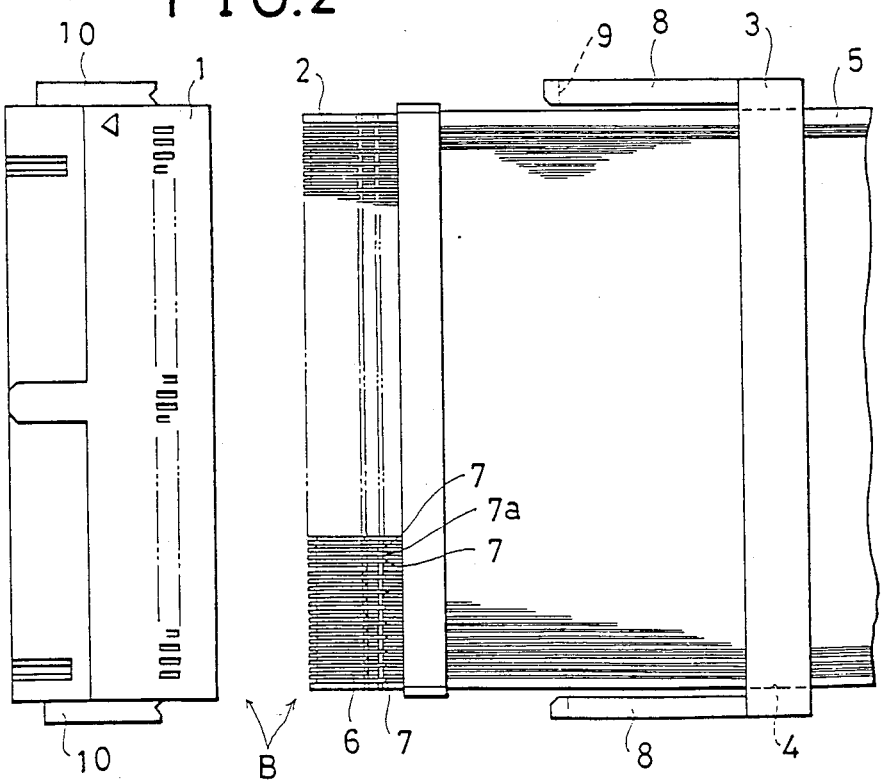
FIG. 2 is a exploded top plan view thereof.

As illustrated in FIG. 2, the female connector B comprises a contact housing 1, a cable base 2 and a covering member 3. The covering member 3 is provided with an opening 4, and a flat cable 5 is inserted therethrough.

As illustrated in FIGS. 2 to 6, the flat cable 5 comprises plural signal conductors 6 and plural ground conductors 7 which are disposed in parallel with each other and on a single common plane. The conductors 6, 7 are provided with respective exposed end portions extending forward and exposed outside from the cable 5. In more detail, the conductors 6, 7 are so arranged as to have mutual relations such that each pair of ground conductors 7, 7 may be disposed on both sides of each signal conductor 6.

After the cable base 2 which is previously so arranged that the respective exposed end portions of the conductors 6, 7 of the flat cable 5 may be placed on at least one of the upper and lower surfaces thereof, is inserted into an internal space 17 formed at a rear portion of the contact housing 1, the covering member 3 is attached to the contact housing 1 in such a manner that openings 9, 9 made in a pair of right and left engaging members 8, 8 thereof are mounted on projections 10, 10 provided on both side surfaces of the housing 1 and thus the covering member 3 may serve to ensure the joint between the cable base 2 and the contact housing 1, and to prevent dust or the like from entering the connector B.

In the illustrated example, the respective end portions of the conductors 6, 7 are placed on the cable base 2 so as to be bent into a U-shaped form to extend from the lower surface, through the forward end surface to the upper surface of the cable base 2.

As shown in FIGS. 3–8, plural signal contact members 11 having respective contact portions **11*b* projecting forward and plural ground contact members 12 having no contact portions are mounted in the contact housing 1 under the condition that the members 11 and 12 are disposed alternately one with another and in parallel with each other. A U-shaped leading portion 12*a* of each of the ground contact members 12 is longer than a U-shaped leading portion 11*a* of each of the signal contact members 11, and the leading portions 11*a*, 12*a* project rearward into the foregoing internal space 17 of the contact housing 1**.

The contact portions **11*b*, 11*b* of each pair of signal contact members 11, 11 adjacent one with another are displaced upwards and downwards one from another and are bent inwards so as to be positioned on a single common vertical plane. This arrangement is preferably performed in such a way that each pair of signal contact members 11, 11 having contact portions 11*b*, 11*b* are previously constructed into contacts of equal shape, and at the time of arrangement thereof, one of the two is turned over in relation to the other. Thus, the foregoing arrangement of the two contact members with their contact portions 11*b*, 11*b*** disposed as set forth above can be obtained.

The cable base 2 has a width substantially equal to the width of the flat cable 5, and is provided with plural shallow grooves **14*b* in the form of a U-shape and plural deep grooves 14*a* in the form a U-shape extending in the direction intersecting at right angles the width direction thereof in such a manner that the grooves 14*b*, 14*a* are disposed alternately and in parallel one with another. The grooves are arranged so that the end portion of each signal conductor 6 may be placed in each shallow groove 14*b* so as to extend along the cable base 2 from its lower surface to its upper surface through its front surface. The end portions of each pair of the ground conductors 7, 7 adjacent one with another may be placed in each deep groove 14*a*** so as to extend along the same from its lower surface to its upper surface through its front surface.

Figure 8:
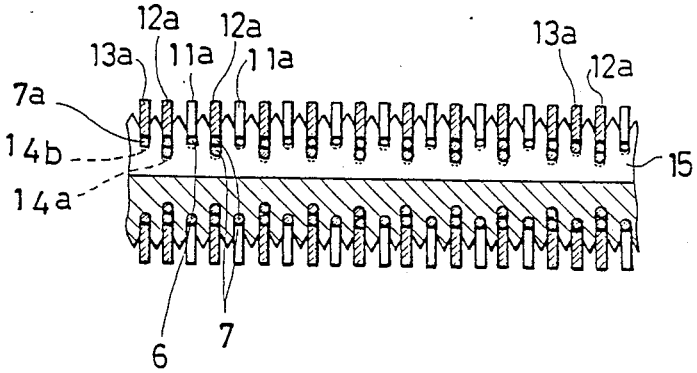
FIG. 8 is a sectional view taken along the line VIII—VIII in FIG. 7.

Additionally, the cable base 2 is provided therein with a conductive material made bus bar 15 extending in the width direction and having respective grooves of which the bottoms protrude to be positioned slightly above the respective bottom surfaces of those grooves **14*b*, 14*a*, as shown clearly in FIG. 8**.

Figure 9:
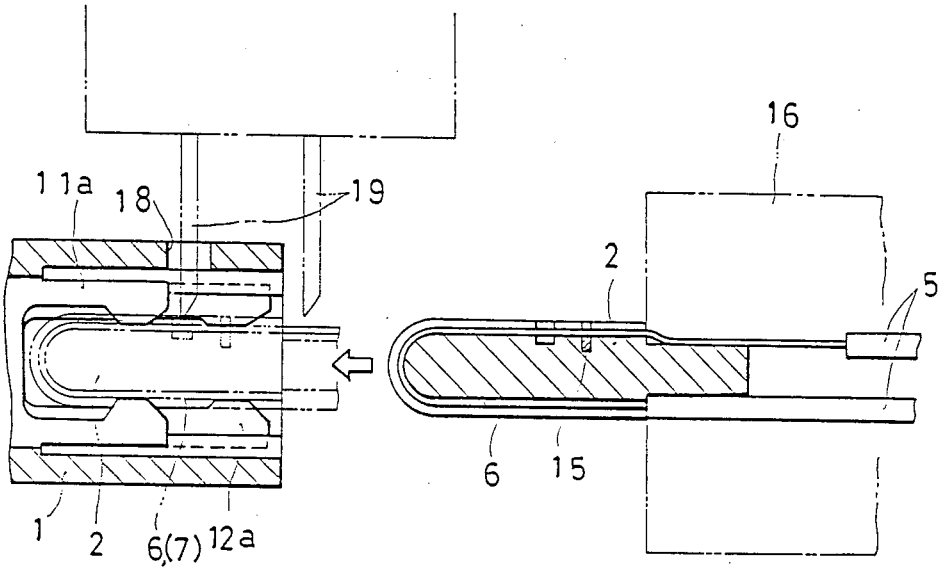
FIG. 9 is a diagram for explaining an assembling operation thereof.

For providing the respective end portions of the signal conductors 6 and the ground conductors 7 of the flat cable 5 on the cable base 2, it is carried out in such a procedure so that, as shown in FIG. 9, the end portion of each of the signal conductors 6 is placed in each shallow groove **14*b* and the end portions of each pair of ground conductors 7, 7 are placed in each deep groove 14*a*. Then the resultant U-shaped bent end portions thereof are firmly held by a jig 16 against the cable base 2, and are then inserted into the internal space 17 of the housing 1. The distance between the upper and lower parts of each of the U-shaped bent end portions of the signal conductors 6 and the ground conductors 7 on the cable base 2 is slightly larger than the interval space between a pair of mutually facing upper and lower leg portions of each of the leading portions 11*a*, 12*a* of the respective conduct members 11, 12, so that at the time of the foregoing insertion of the cable base 2, each end portion of each of the conductors 6, 7 can be pushed from above and below by each corresponding one of the U-shaped leading portions 11*a*, 12*a* so as to be brought into pressure contact with the bus bar 15. Thereafter, the conductors 6 and 7 are cut by a cutter 19 through an opening 18 made in the housing 1 and at the outside of the housing 1**, respectively.

In more detail, the cut positions thereof are such that each ground conductor 7 is cut at a position to the rear of the bus bar 15 so as to remain in contact with the bus bar 15. In addition, each signal conductor 6 is cut at a position in front of the bus bar 15, that is, the position of the opening 18, so as to not make contact therewith.

Figure 3:
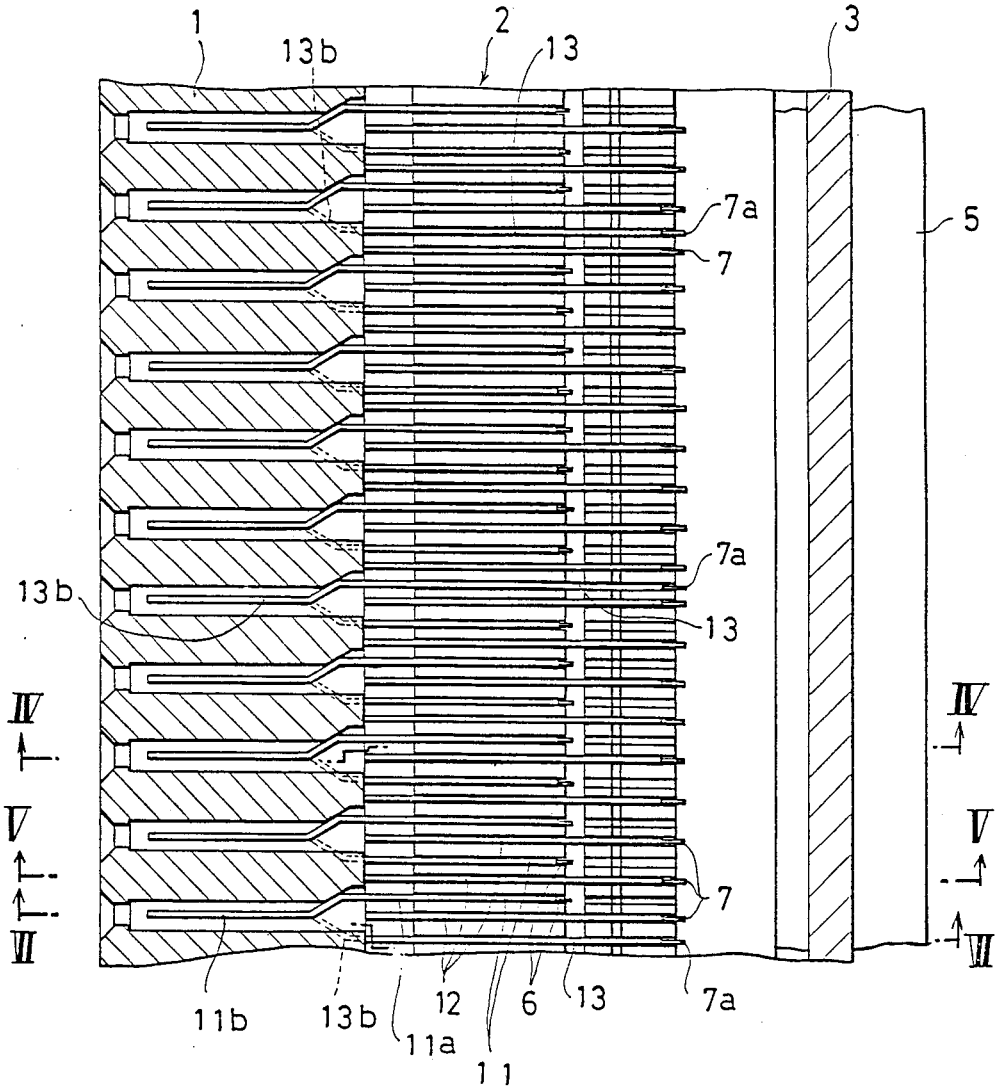
FIG. 3 is an enlarged sectional view taken along the line III—III in FIG. 1.
Figure 4:
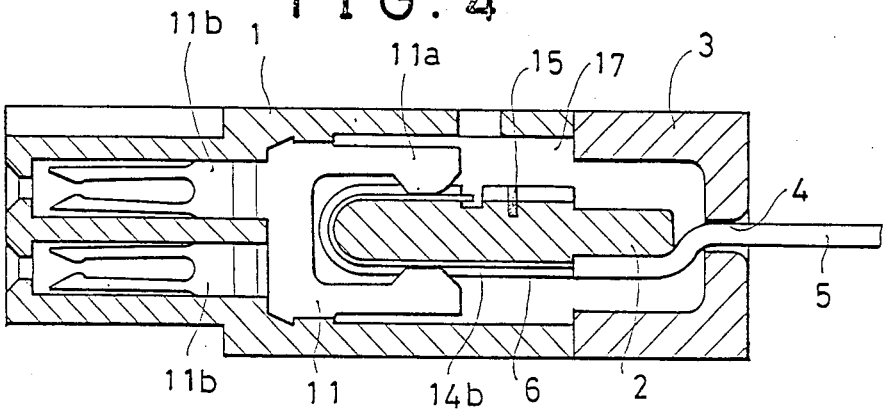
FIGS. 4–6 are sectional views taken respectively along the lines IV—IV, V—V and VI—VI in FIG. 3.

Additionally, in this embodying example, at least one signal conductor selected from the plural signal conductors 6, for instance, spaced conductors at an interval of eight conductors thereof as shown clearly in FIG. 3, are arranged to be used for respective ground conductors **7*a*. At the same time, the corresponding signal contact members 11 are arranged to be used for ground contact members 13 having a contact portion 13*b* for external connection. In this arrangement, the ground conductor 7*a* is prepared by cutting the signal conductor 6 at a position to the rear of the bus bar 15 so as to make contact with the bus bar 15. The leading portion 13*a* of the ground contact member 13 is prepared by elongating the leading portion 11*a* of the contact 11, as to be formed into a longer contact which is substantially equal to the leading portion 12*a* of the foregoing ground contact member 12**.

Figure 5:
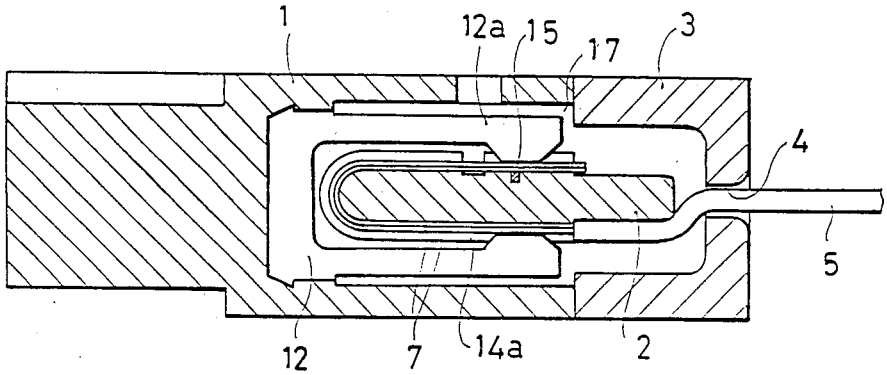
Figure 6:
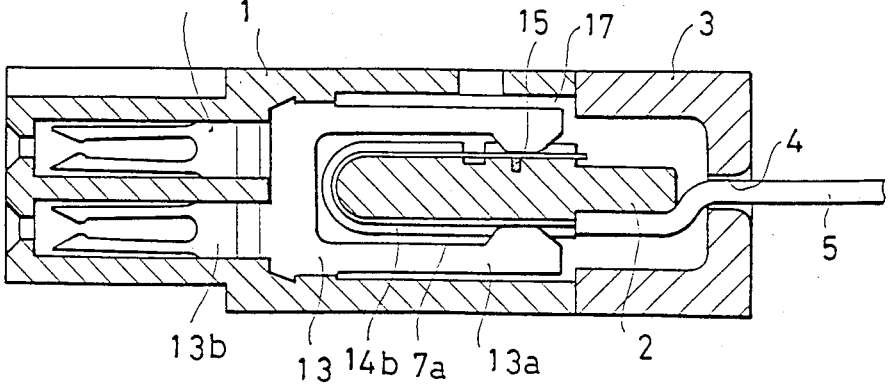
Figure 7:
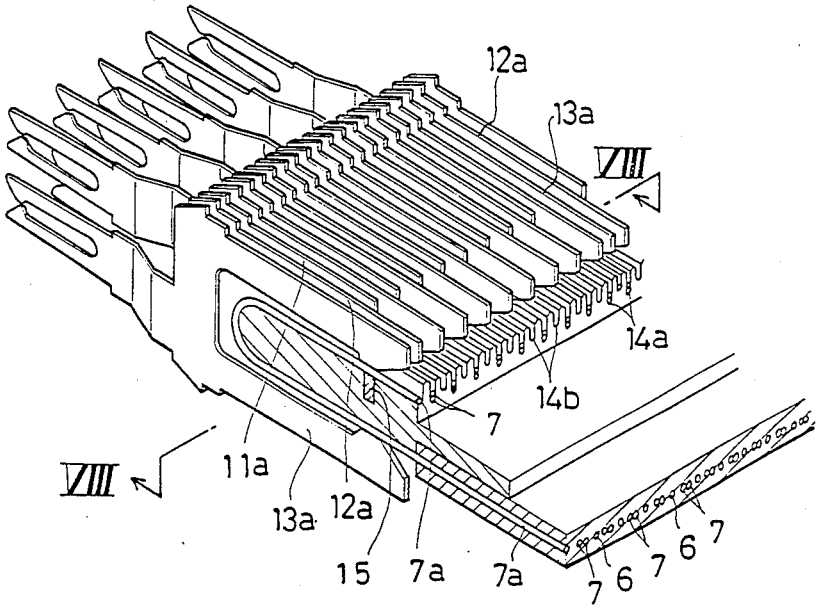
FIG. 7 is a partial perspective view of an important portion of the connector.

Thus, if the cable base 2 is mounted in the contact housing 1, the end portion of each of the signal conductors 6 is brought into pressure contact with the short leading portion **11*a* of the corresponding one of the signal contact members 11. As shown in FIG. 7, the end portion of each of the ground conductors 7*a* is brought into pressure contact with the leading portion 13*a* of the ground contact member 13 for external connection having the contact portion 13*b*, resulting in its pressure contact with the bus bar 15. As shown in FIGS. 5 and 8, each pair of the ground conductors 7 are brought into pressure contact with the leading portion 12*a* of the corresponding one of the ground contact members 12 having no contact portions resulting in its pressure contact with the bus bar 15**.

Figure 1:
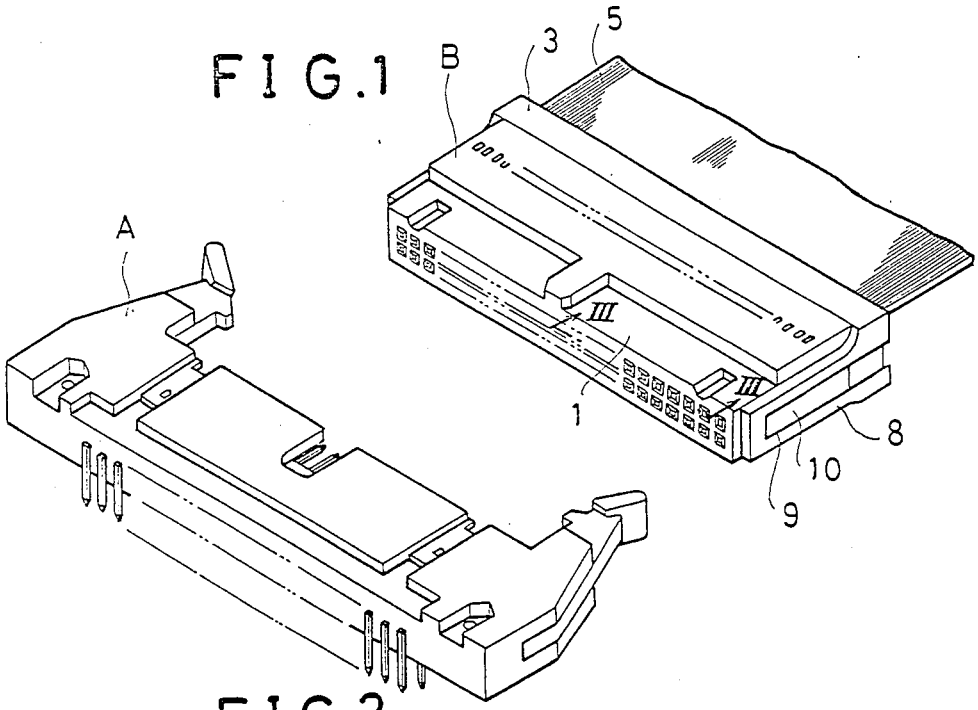
FIG. 1 is a perspective view of a female connector for a flat cable of one embodying example of the present invention disconnected from a male connector.

Consequently, all the ground conductors 7 of the flat cable 5 are connected to each of the ground contact members 13 through the bus bar 15. The ground conductors 7 are brought into pressure contact with the bus bar 15 by the respective ground contact members 12. The ground conductors **7*a* which are under pressure contact with the bus bar 15, are further connected through the contact portion 13*b* of the ground contact members 13, to the corresponding contact members of the male connector A as shown in FIG. 1**, resulting in the conductors being grounded through the male connector A.

FIGS. 10–16 show another embodying example of the present invention. This embodying example is similar to the foregoing example except for the following differences.

Figure 10:
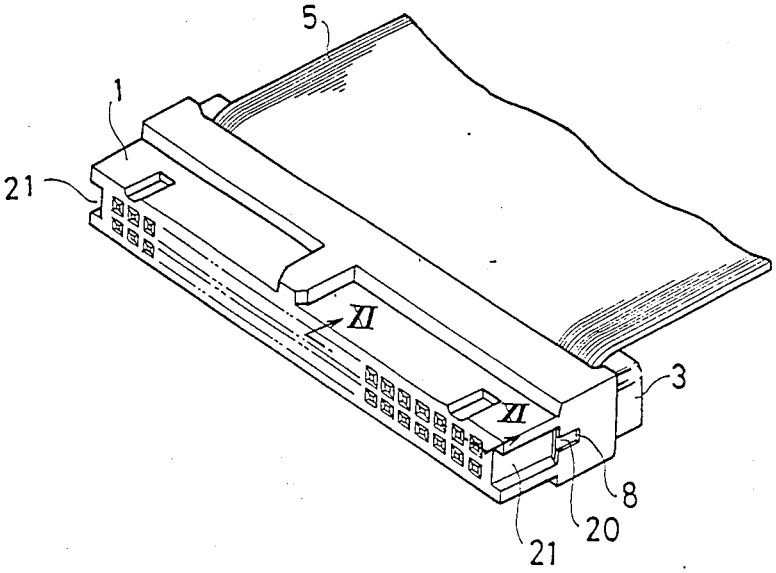
FIG. 10 is a perspective view of a female connector of another embodying example of the present invention.
Figure 11:
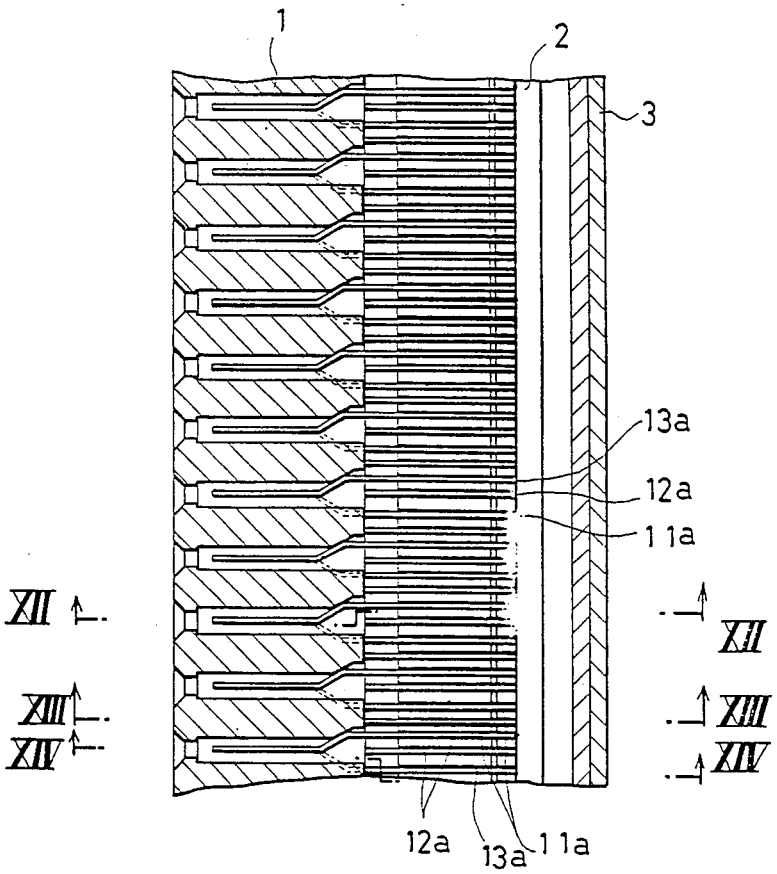
FIG. 11 is an enlarged sectional view taken along the line XI—XI in FIG. 10.
Figure 12:
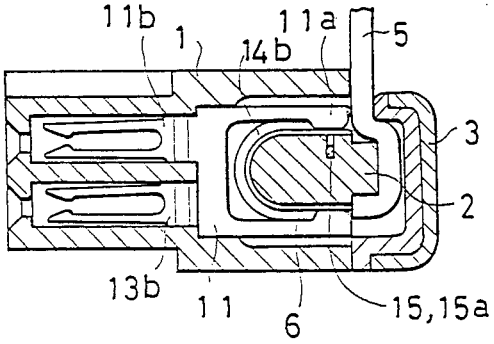
FIGS. 12–14 are sectional views taken respectively along the lines XII—XII, XIII—XIII and XIV—XIV in FIG. 11.
Figure 13:
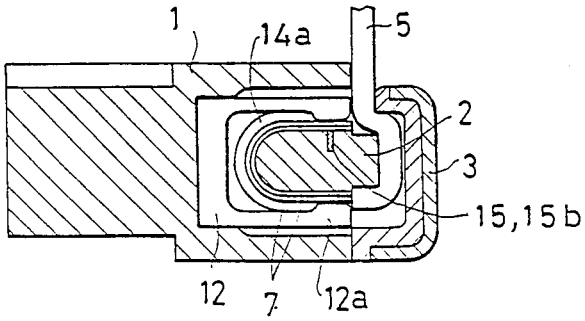
Figure 14:
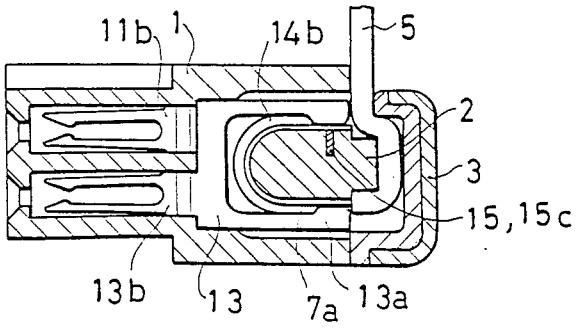
Figure 15:
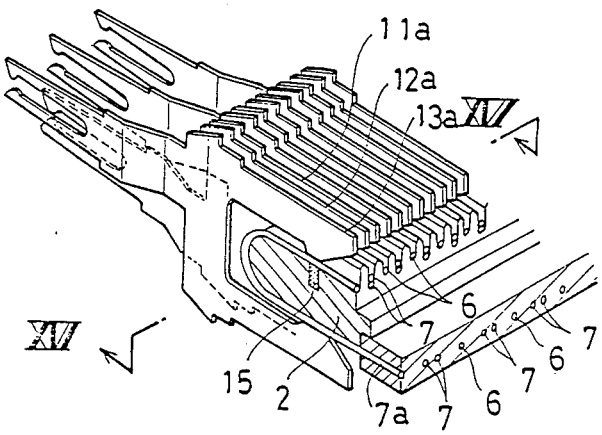
FIG. 15 is a partial perspective view of an important portion of the connector.
Figure 16:
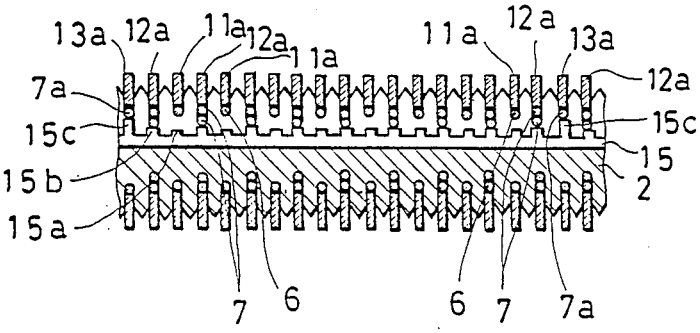
FIG. 16 is a sectional view taken along the line XVI—XVI in FIG. 15.
Figure 17:
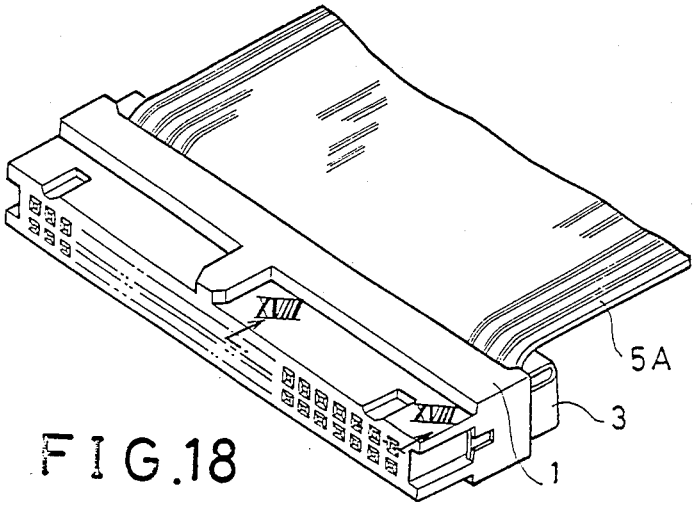
FIG. 17 is a perspective view of a female connector of further another embodying example of the present invention.
Figure 18:
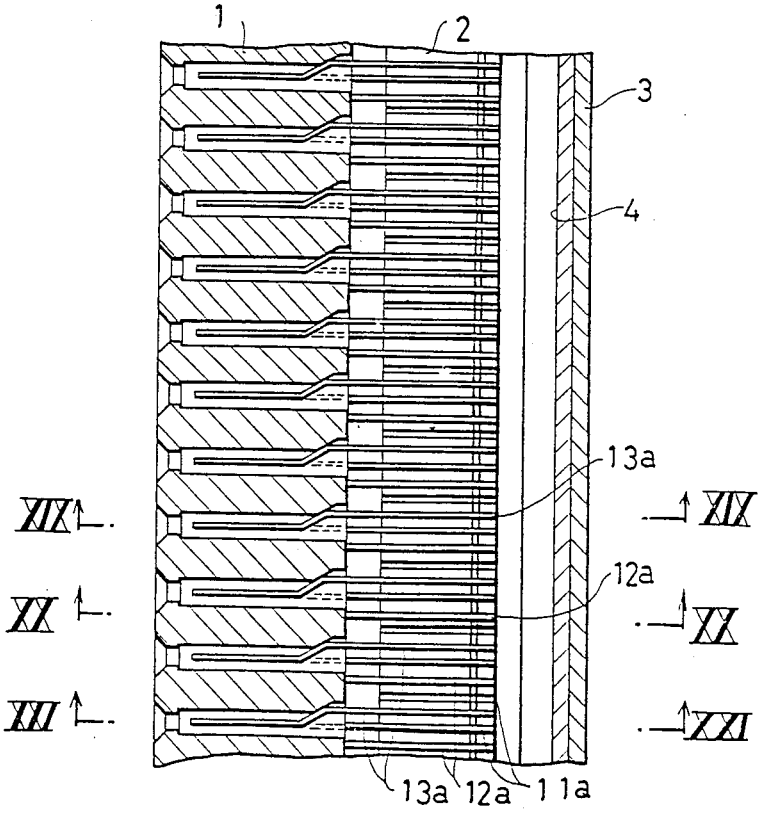
FIG. 18 is an enlarged sectional view taken along the line XVIII—XVIII in FIG. 17.
Figure 19:
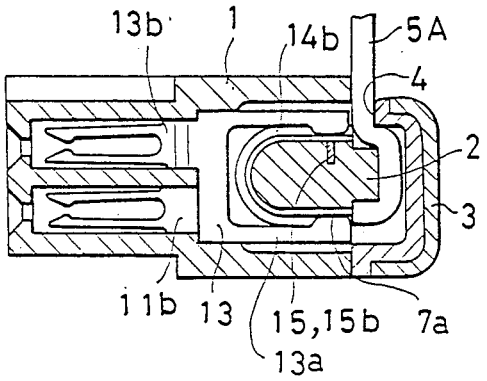
FIGS. 19–21 are sectional views taken along the lines XIX—XIX, X—X and XXI—XXI in FIG. 18.
Figure 20:
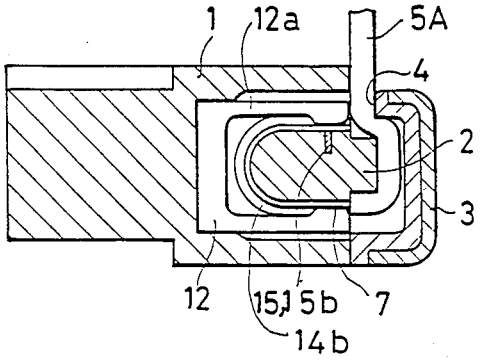
Figure 21:
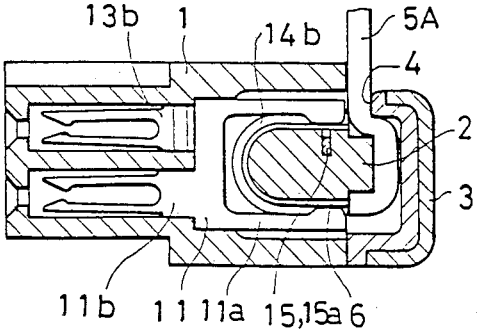

In the second example, as shown in FIG. 10, the covering member 3 is attached to the housing 1 by means of a claw member 20. An engaging member 8 is engaged with a cut-out portion 21 on each side surface of the housing 1. Additionally, as shown clearly in FIGS. 12–15, the leading portion 11*a* of each of the signal contact members 11, the leading portion 12*a* of each of the ground contact members 12, and the leading portion 13*a* of the ground contact member 13 for external connection are formed to be substantially equal in length. As shown clearly in FIG. 16, the bus bar 15 is provided with respective projecting portions 15*a*, 15*b*, 15*c* corresponding to the respective leading portions 11*a*, 12*a*, 13*a*. Only the projecting portion 15*a* facing each of the leading portions 11*a* is formed to be too short to make contact with the corresponding signal conductor 6, as shown in FIG. 12 and FIG. 16.

According to this embodying example, all the leading portions 11*a*, 12*a*, 13*a* of the signal contact members 11, the ground contact members 12 and the ground contact members 13 for external connection are substantially equal in shape one with another and are comparatively short in length, so that the connector can be made comparatively small in size as a whole and the number of parts thereof can be decreased.

FIGS. 17–23 show further another embodying example of the present invention. This example is similar to the foregoing first and second examples except for the following differences.

Namely, in the third example, the interval between the mutually adjacent signal conductors 6 of the flat cable 5 is twice as wide as the interval between the conductors in each of the foregoing examples. The grooves for the ground conductors 7 and the grooves for the signal conductors 6 made in the cable base 2 are all formed into shallow grooves 14*b*. Each ground conductor 7 is mounted into each shallow group 14*b*.

Figure 22:
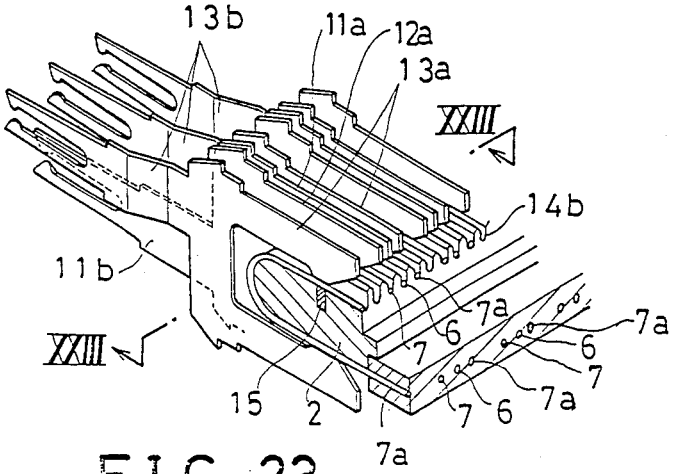
FIG. 22 is a partial perspective view of an important portion of the connector.
Figure 23:
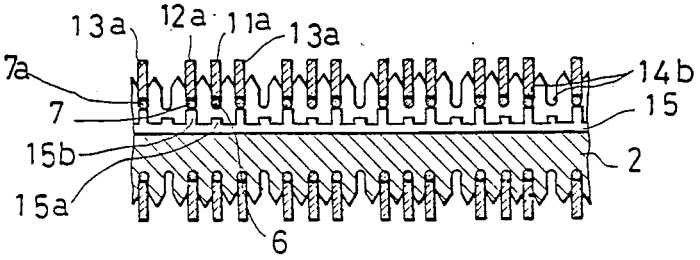
FIG. 23 is a sectional view taken along the line XXIII—XXIII in FIG. 22.
Figure 24:
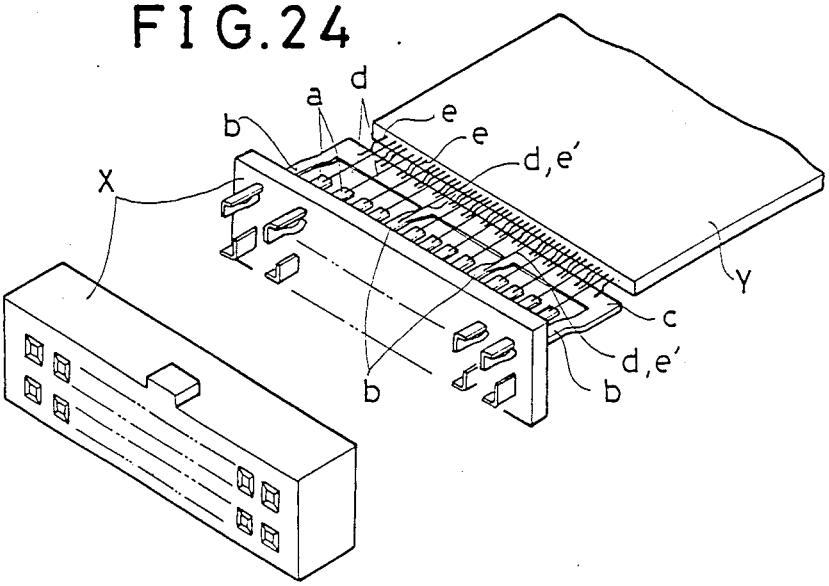
FIG. 24 is an explanation diagram showing a conventional example.

Additionally, in the foregoing first and second examples, at least one conductor selected from the plural signal conductors 6 are arranged to be used for the ground conductor 7*a* for external connection. In the third example, either one of each pair of ground conductors 7, 7 on both sides of each of the signal conductors 6 is arranged to be used for the ground conductor 7*a* for external connection. Each ground contact member 12 corresponding thereto is formed into the ground contact member 13 having the contact portion 13*b* projecting forwards therefrom for external connection. In this example, as shown in FIG. 22, the leading portions 11*a*, 12*a*, 13*a* of the contact members 11, 12, 13 are formed to be equal one with another in length. As shown in FIG. 23, the bus bar 15 is provided with projections 15*a* and 15*b*. Each of the projecting portions 15*a* thereof corresponding to the leading portions 11*a* is formed to be too short to make contact with the corresponding signal conductor 6. This construction is similar to the second example.

Additionally, in the third example, the contact portion 13*b* of the ground contact member 13 for external connection and the contact portion 11*b* of the signal contact member 11 adjacent thereto are displaced upwards and downwards one from another. Only one of the two, that is, only the contact portion 13*b* is bent towards the other 11*b* thereof so that the two 13*b*, 11*b* may be positioned on a single common vertical plane.

If the cable base 2 is mounted into the contact housing 1, each of the signal conductors 6 is brought into pressure contact with the corresponding one of the leading portions 11*a* of the signal contact members 11. Each ground conductor 7 on one side of the signal conductor 6 is brought into pressure contact with the bus bar 15 by the corresponding leading portion 12*a* of the ground contact member 12. In addition, each ground conductor 7*a* on the other side thereof is brought into pressure contact with the bus bar 15 by the corresponding leading portion 13*a* of the ground contact member 13 for external connection. Consequently, each ground conductor 7 of the flat cable 5A is connected, through the bus bar 15 and each corresponding ground conductor 7*a* on one side thereof, to each corresponding ground contact member 13 for external connection, and is connected to each corresponding contact member of the male connector A, resulting in grounding of the conductor.

Thus, according to this invention, if the cable base is inserted into the internal space of the cable housing, each contact member is brought into pressure contact, at its leading portion, with each conductor or the bus bar through each conductor, so that the connection between each conductor and each corresponding contact member and the connection between each conductor and the bus bar can be obtained easily, simply and reliably.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A connector for a flat cable comprising:

a contact housing having a plurality of signal contact members and a plurality of ground contact members being disposed alternately and in parallel with one another, said plurality of contact members being housed within said contact housing and with respective leading portions of the contact members projecting into an internal space formed at a rear portion thereof;

a cable base containing a flat cable comprising a plurality of signal conductors and a plurality of ground conductors disposed alternately and in parallel with one another within said cable base, respective exposed end portions of the conductors being positioned within said cable base on at least one of an upper and lower surface of the cable base, wherein the end portion of each of the conductors is placed on the cable base so as to extend from the lower surface of the cable base to the upper surface thereof, and the leading portion of each of the contact members is formed into a U-shaped having a pair of leg portions for holding the end portion of the conductor against the base from above and below; and a bus bar provided in the cable base and being in contact with the end portions of the ground conductors;

wherein upon inserting the cable base into the internal space of the contact housing, a leading portion of each of the signal contact members may be brought into pressure contact with the end portion of the corresponding signal conductors and a leading portion of each of the ground contact members may be brought into contact with a portion of the naked end portion of the corresponding ground conductors being in contact with the bus bar.

2. A connector according to claim 1, wherein the contact housing is provided on a rear side with a covering member which is detachably attached thereto for covering the cable base.

3. A connector according to claim 1, wherein at least one conductor selected from the plurality of signal conductors includes an end portion thereof for contacting the bus bar and being brought into pressure contact therewith by the leading portion of the corresponding signal contact member for connecting the signal contact member as a ground contact member for external connection.

4. A connector according to claim 1, wherein at least one conductor selected from the plurality of signal conductors includes an end portion thereof for contacting the bus bar and being brought into pressure contact therewith by the leading portion of the corresponding signal contact member for connecting the signal contact member as a ground contact member for external connection.

5. A connector according to claim 2, wherein at least one conductor selected from the plurality of signal conductors includes an end portion thereof for contacting the bus bar and being brought into pressure contact therewith by the leading portion of the corresponding signal contact member for connecting the signal contact member as a ground contact member for external connection.

6. A connector according to claim 1, wherein either one of each pair of ground contact members on both sides of each of the signal contact members is formed into a ground contact member having a contact portion for external connection.

7. A connector according to claim 1, wherein either one of each pair of ground contact members on both sides of each of the signal contact members is formed into a ground contact member having a contact portion for external connection.

8. A connector according to claim 2, wherein either one of each pair of ground contact members on both sides of each of the signal contact members is formed into a ground contact member having a contact portion for external connection.

9. A connector according to claim 3, wherein the leading portion of each of the ground contact members is extended to be longer relative to the leading portion of each of the signal contact members for positioning an extended portion of the bus bar.

10. A connector according to claim 3, wherein the leading portion of each of the ground contact members and the leading portion of each of the signal contact members are formed to be equal in length with one another and the bus bar is provided with projecting portions corresponding to the respective leading portions with each projecting portion corresponding to the leading portion of each of the signal contact members being too short to be in contact with the leading portion of said signal contact.

11. A connector according to claim 3, wherein the contact portions of each pair of signal contact members adjacent with one another are displaced upwards so as to be aligned with each other on a single common vertical plane.

12. A connector according to claim 4, wherein contact portions of the ground contact member for external connection and the contact portions of the signal contact member adjacent thereto are disposed upwards and downwards one from another and one of the contacts is bent inwards towards the other thereof for aligning the contacts with each other on a single common vertical plane.

13. A connector according to claim 3, wherein said cable base is provided with shallow grooves each for receiving the end portion of each signal conductor, and deep grooves adjacent said shallow grooves, each said deep grooves being for receiving the end portions of each pair of ground conductors.

14. A connector according to claim 4, wherein the cable base is provided with shallow grooves each for receiving the end portion of each signal conductor, and shallow grooves each for receiving the end portion of each ground conductor.

* * * * *